US012733731B1

(12) United States Patent
Ciciora et al.

(10) Patent No.: US 12,733,731 B1
(45) Date of Patent: Sep. 15, 2026

(54) UTILITY BELT WITH RAISED DIVIDERS

(71) Applicant: Truewerk, Inc., Denver, CO (US)

(72) Inventors: Brian Ciciora, Denver, CO (US); Jason Fryda, Denver, CO (US); Michael Munter, Ashland, OR (US)

(73) Assignee: Truewerk, Inc., Denver, CO (US)

( * ) Notice: Subject to any disclaimer, the term of this patent is extended or adjusted under 35 U.S.C. 154(b) by 0 days.

(21) Appl. No.: 19/289,971

(22) Filed: Aug. 4, 2025

(51) Int. Cl.
*A45F 5/02* (2006.01)

(52) U.S. Cl.
CPC ..... *A45F 5/021* (2013.01)

(58) Field of Classification Search
CPC ..... A45F 5/021
USPC ..... 2/310, 312, 336, 338
See application file for complete search history.

(56) References Cited

U.S. PATENT DOCUMENTS 2,530,850 A * 11/1950 Atchley ..... A41F 11/02 D2/625
3,496,944 A * 2/1970 Cuozzi ..... A41B 11/126 2/407
3,501,774 A * 3/1970 Norman ..... A41F 11/16 24/306
3,932,897 A * 1/1976 Young ..... A41F 11/00 2/920
4,747,527 A * 5/1988 Trumpower, II ..... A41F 9/002 224/907
4,819,846 A * 4/1989 Hannemann ..... A45F 5/00 224/241
5,214,806 A * 6/1993 Flores ..... A41F 5/00 2/338
5,540,188 A * 7/1996 Heinrichs ..... A47D 13/086 119/770
5,730,339 A * 3/1998 Stolfo ..... A45F 5/02 220/737
6,131,206 A * 10/2000 Vayda ..... A41F 11/00 2/315
6,701,534 B2 * 3/2004 Guibord ..... B25H 3/00 224/904
6,913,176 B1 * 7/2005 Buscemi ..... A45F 5/021 224/665
11,470,950 B2 * 10/2022 Hawkins ..... A45F 5/021
2005/0277491 A1 * 12/2005 Nolan ..... A63B 21/06 473/519
2009/0095785 A1 * 4/2009 Woolery ..... A41D 13/0012 224/183
2022/0071376 A1 * 3/2022 Brown ..... A45F 3/005
2022/0316839 A1 * 10/2022 Shipley ..... A45F 5/021
2023/0337809 A1 * 10/2023 Wagner, II ..... A45F 3/005
2023/0380547 A1 * 11/2023 Paik ..... A44B 11/258

* cited by examiner

*Primary Examiner* — Gloria M Hale
(74) *Attorney, Agent, or Firm* — Lynch LLP; Sean Lynch

(57) ABSTRACT

A utility belt is disclosed, featuring a first and second tether portion comprising either synthetic fibers such as nylon or polyester, or natural fibers such as cotton or hemp. The first tether portion is attached to a male buckle using various connection techniques including stitching, riveting, or adhesive bonding, and the second tether portion is coupled to a female buckle. The belt incorporates raised divider portions, optionally coated with, e.g., neoprene or rubber, and spaced equally apart.

17 Claims, 4 Drawing Sheets

UTILITY BELT WITH RAISED DIVIDERS

FIELD OF THE INVENTION

The field of the invention is utility belts.

BACKGROUND

The background description includes information that may be useful in understanding the present invention. It is not an admission that any of the information provided in this application is prior art or relevant to the presently claimed invention, or that any publication specifically or implicitly referenced is prior art.

The utility belt has long been a staple in various professions, particularly those requiring the transportation and accessibility of multiple tools and devices. Traditional utility belts, while effective in providing a means to carry tools, often suffer from the lack of organization and security for the items they hold. Over time, as the user moves, tools can shift, leading to potential damage, loss, or difficulty in quickly accessing the necessary equipment.

Furthermore, standard utility belts may not accommodate the diverse range of tools needed by modern professionals. As tasks become more specialized, the need for a customizable, organized, and secure utility belt becomes increasingly evident. Raised dividers within the utility belt can address these challenges by providing designated slots for each tool, ensuring that they remain in place and are easily accessible when needed.

Additionally, there is a need for utility belts that are comfortable to wear for prolonged periods. Many existing designs can cause discomfort due to uneven weight distribution or inadequate padding. A utility belt with raised dividers can help distribute weight more evenly, reducing strain on the wearer and enhancing overall comfort.

Given these considerations, there exists a significant need in the art for an improved utility belt design that offers enhanced organization, security, and comfort for users. Embodiments of the inventive subject matter described in this application aim to address these shortcomings by introducing a utility belt with raised dividers, offering a practical solution to the challenges faced by professionals in various fields that use utility belts.

SUMMARY OF THE INVENTION

The present invention provides apparatuses, systems, and methods directed to utility belts having divider sections with raised dividers. In one aspect of the inventive subject matter, a utility belt, comprises: a male buckle; a first tether portion coupled with the male buckle; a first raised divider portion coupled with the first tether portion; a second tether portion coupled with the first raised divider portion; a second raised divider portion coupled with the second tether portion; a third tether portion coupled with a female buckle; where the first raised divider portion comprises first raised dividers; and where the second raised divider portion comprises second raised dividers.

In some embodiments, the first tether portion is coupled to the male buckle by one or more connection techniques such as stitching, riveting, or adhesive bonding. The first tether portion, the second tether portion, and the third tether portion can each comprise synthetic fibers, and the synthetic fibers can be made from nylon or polyester. In some embodiments, the first tether portion, the second tether portion, and the third tether portion each comprise natural fibers, wherein the natural fibers comprise cotton or hemp.

In some embodiments, the first raised divider portion comprises a coating, and the coating can be made from neoprene or rubber. The first tether portion can be coupled with the first raised divider portion by one or more connection techniques such as stitching, riveting, or adhesive bonding. In some embodiments, the male buckle comprises a male strike surface, the female buckle comprises a female strike surface and a magnet.

In another aspect of the inventive subject matter, a utility belt comprises: a male buckle; a first tether portion coupled with the male buckle; a raised divider portion coupled with the first tether portion, wherein the raised divider portion comprises raised dividers; a second tether portion coupled with the raised divider portion; and a female buckle coupled with the second tether portion.

In some embodiments, the first tether portion is coupled to the male buckle by one or more connection techniques such as stitching, riveting, or adhesive bonding. The first tether portion and the second tether portion each can be made from synthetic fibers, where the synthetic fibers comprise nylon or polyester. In some embodiments, the first tether portion and the second tether portion each comprise natural fibers, where the natural fibers are made from cotton or hemp.

In some embodiments, the raised divider portion can feature a coating, where the coating can include a neoprene or rubber material. In some embodiments, the first tether portion is coupled with the raised divider portion by one or more connection techniques such as stitching, riveting, or adhesive bonding. In some embodiments, the raised dividers are spaced apart equally. And in some embodiments, the male buckle features a male strike surface, the female buckle features a female strike surface, and wherein the female buckle further comprises a magnet.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Embodiments of the inventive subject matter are directed to a utility belt that includes raised dividers on sections of the belt to enhance the organization and accessibility of tools and accessories. Utility belts are widely used in various professions, including construction, electrical work, and gardening, where quick and easy access to tools is essential. But conventional utility belts often lack effective means for organizing tools, maintaining consistent spacing between tools, and allowing for the inclusion of different tools in designated locations on the utility belt.

The disclosed utility belt addresses these issues by incorporating raised dividers that create distinct sections on the belt. These dividers not only prevent tools from shifting but also allow for a systematic arrangement of items, thereby improving the overall functionality of the belt. The raised dividers are designed to provide optimal spacing and support for a variety of tools, ensuring that each tool remains securely in place while allowing for quick retrieval. Raised dividers of the inventive subject matter can be regularly spaced apart (e.g., equally spaced apart), or, in some embodiments, they can be spaced apart at irregular intervals.

Figure 1:
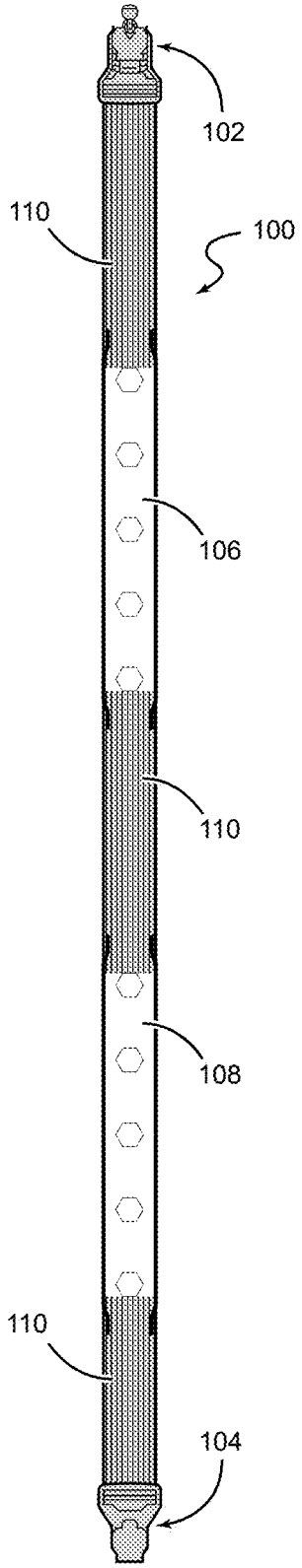
FIG. 1 shows a utility belt of the inventive subject matter.
Figure 1A:
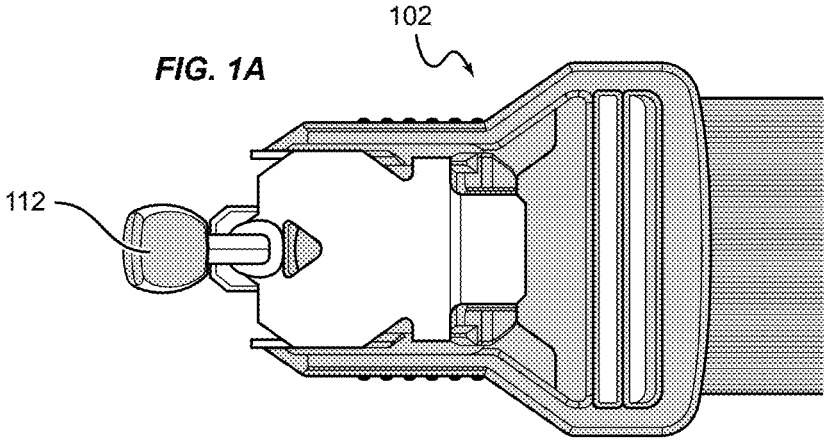
FIG. 1A shows a closer view of a male buckle.
Figure 1B:
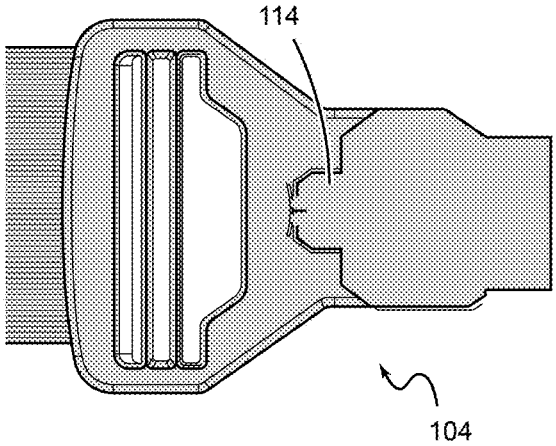
FIG. 1B shows a closer view of a female buckle.

FIG. 1 shows a front side of a utility belt of the inventive subject matter. Utility belt 100 features a male buckle 102 and a female buckle 104. Male buckle 102 is shown in more detail in FIG. 1A and female buckle 104 is shown in more detail in FIG. 1B. Male buckle 102 is shown in FIG. 1A. Male buckle 102 comprises a male protruding portion 112, which is configured to mate with female receiving portion 114. Female buckle 104 is shown in FIG. 1B. Female buckle 104, as mentioned, comprises female receiving portion 114. When male protruding portion 112 is mated with female receiving portion 114, it forms a connection that requires some amount of force to separate, where the amount of force required to separate the two components is sufficiently high that the two components do not separate unintentionally. In some embodiments, the male buckle 102 can lock into female buckle 104 such that the components can only separate upon orientating the male buckle 102 relative to the female buckle 104 at a certain angle, or such that male buckle 102 can only separate from female buckle 104 when pressure is applied to male buckle 102 to bring it into an unlatching configuration. Male buckle 102 is configured to mate with female buckle 104 to form utility belt 100 into a loop around a wearer's waist.

Utility belt 100 also features a left divider section 106 and a right divider section 108. Although the embodiment shown in FIG. 1, for example, shows a left divider section 106 and right divider section 108, it should be understood that there can be more than two dividers and as few as one divider.

Figure 2:
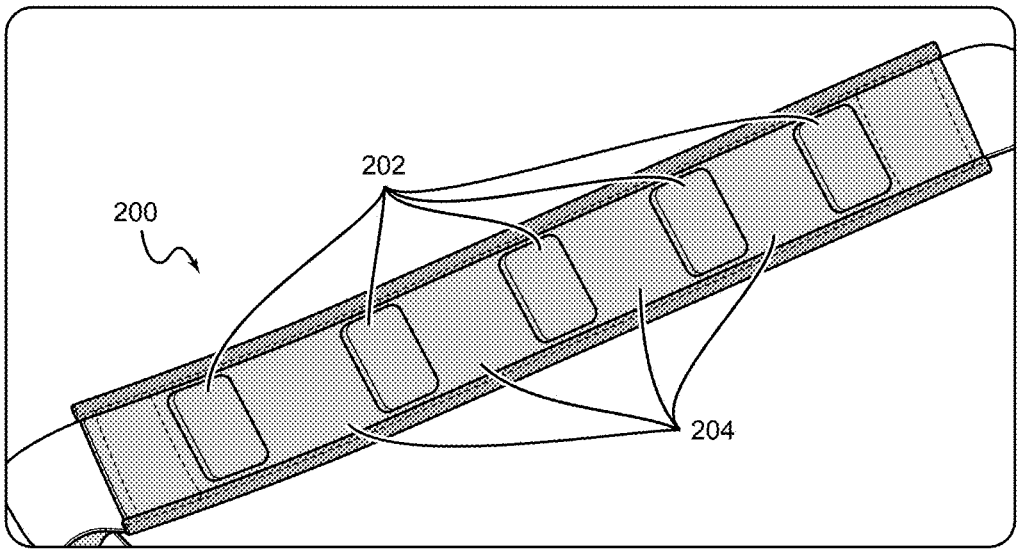
FIG. 2 shows a raised divider portion.

Left divider section 106 comprises left raised portions that divide its surface into different sections. Right divider section 108 also features right raised portions that divide its surface into different sections. FIG. 2 shows a back side of a divider section as described in relation to FIG. 1. Divider section 200 features raised portions 202 that create flatter sections therebetween. Raised portions 202 are disposed on divider section 200 opposite raised portions on the opposite side (e.g., the rectangular sections as shown and described in FIG. 1). Flat portions 204, in association with flat portions on the opposite side of divider section 200, are configured to accommodate attachments that can couple with utility belts of the inventive subject matter.

Raised portions on either side of a divider section of the inventive subject matter can be formed in several ways. In some embodiments, each divider section is formed as a molded rubber or flexible plastic piece that includes the raised portions disposed on one surface. The raised portions can be formed according to any shape or design. The raised portions in FIG. 1 (a front side of a belt of the inventive subject matter) comprise hexagonal protrusions while the raised portions in FIG. 2 (a back side of a belt of the inventive subject matter) comprise raised rectangles.

Left and right divider sections can be manufactured in a variety of ways. For example, molding techniques can be implemented. A divider portion of the inventive subject matter can be molded from rubber or flexible plastic. This process starts with creating a mold in a desired shape that incorporates cavities that form the raised portions. Molten material is then poured into the mold and allowed to cool and solidify, resulting in a strip with raised portions.

Alternatively, a divider of the inventive subject matter can be manufactured through an extrusion process. In this method, heated material is forced through a die that shapes the strip, including the raised portions. As the material cools, it retains the raised portions, providing the necessary structure for the utility belt.

Another approach is to attach pre-formed raised elements to a flat strip. These elements can be affixed using adhesives, through a stitching mechanism, by a fastener like screws, staples, or the like, all of which ensure the raised portions are securely bonded to the base material of the divider, offering the desired functionality and durability.

Yet another approach involves taking a section of material having a thickness and then compressing that material using a mold. The shape the material takes on features raised portions and flat portions therebetween, where the thickness of the raised portions (from front raised portions through to back raised portions) can be no greater than the initial thickness of the stock material before compression.

In some embodiments, a divider can be coated with various materials to enhance its performance, durability, and aesthetics. For instance, a rubber coating may be applied to improve the coefficient of friction, ensuring that tools and attachments remain securely in place. Additionally, rubber coatings can provide resistance to wear and tear, extending the lifespan of the utility belt.

Another possible coating is a thermoplastic elastomer (TPE), which offers a combination of flexibility and resilience, making it ideal for applications requiring repeated bending or flexing. TPE coatings can also provide a comfortable grip and are resistant to environmental factors such as UV radiation and moisture.

Furthermore, a polyurethane coating can be used to add a layer of toughness and abrasion resistance. Polyurethane is known for its durability and ability to withstand harsh conditions, making it suitable for heavy-duty applications. This type of coating can also provide a sleek, polished appearance, enhancing the overall look of the utility belt.

In some cases, a fabric layer may be added to the divider for added comfort and aesthetic appeal. Fabrics such as nylon or polyester can be used to create a soft, cushioned surface that reduces irritation when worn for extended periods. Additionally, fabric coatings can be treated with water-resistant or antimicrobial finishes to improve their functionality.

In some embodiments, materials like neoprene in association with a woven fabric adhered to the surface of the neoprene can be adhered to the divider. Neoprene, a synthetic rubber, offers several advantageous properties that make it an excellent material for use on dividers as described. Firstly, neoprene is known for its exceptional flexibility and resilience, allowing the divider to bend and flex without losing its shape or structural integrity. This is particularly important for utility belts, which often undergo repeated bending and flexing during use.

Secondly, neoprene provides excellent resistance to environmental factors such as UV radiation, moisture, and temperature extremes. This ensures that the divider remains durable and functional even when exposed to harsh outdoor conditions. Additionally, the material's inherent resistance to degradation makes it suitable for long-term use.

Another key benefit of neoprene is its cushioning effect, which can enhance the comfort of the utility belt when worn for extended periods. The soft, spongy nature of neoprene reduces friction and irritation against the wearer's body, providing a more comfortable experience.

Furthermore, neoprene's ability to adhere well to various surfaces allows for the easy integration of fabric layers, as mentioned earlier. This combination can create a comfortable and aesthetically pleasing surface that meets the functional requirements of the utility belt.

These coatings and materials can be applied through various methods such as dipping, spraying, or laminating, depending on the desired properties and performance requirements of the utility belt. The choice of coating will depend on the specific needs and preferences of the user, as well as the intended use of the utility belt.

It should be understood that any combination of materials described in this application as being suitable for divider coatings can be implemented in any combination. For example, a rubber coating can be applied to a divider and then a fabric material may be adhered to the rubber coating.

Each divider is surrounded by a tether portion 110. Tether portions can be attached to the dividers through a variety of secure methods to ensure durability and functionality. Common techniques include stitching, riveting, and adhesive bonding. Stitching involves sewing the tether material directly to the divider, providing a strong and flexible connection that withstands tension and movement. Riveting, on the other hand, utilizes metal fasteners to clamp the tether to the divider, offering robust mechanical strength. Adhesive bonding employs specialized glues or tapes to affix the tether to the divider, ensuring a smooth and seamless attachment. Each of these methods can be chosen based on the material properties and the specific requirements of the utility belt's design. One or any combination of these different coupling techniques can be implemented in a given embodiment.

As shown in FIG. 1, for example, the left divider section 106 has tether portions 110 on either side of it. On the left side as drawn, tether portion 110 also connects to a male buckle 102. Tether portion 110 can couple to male buckle 102 by one or more of any of the connection technique discussed above regarding tether portion 110 and left divider section 106.

In some embodiments, utility belts of the inventive subject matter can forego including a tether portion between divider sections, having two divider sections adjacent to each other. It is also contemplated that tether portions can be so short as to functionally cause two divider sections to be adjacent to one another while still fabricating each divider section separately. Some utility belts can feature just a single divider section without deviating from the inventive subject matter, such that the single divider section is surrounded by tether portions that each include a buckle component on their ends opposite from the divider section (e.g., one tether portion includes a male buckle and the other tether portion includes a female buckle).

Tether portions 110 can be made from various materials, each selected for their specific properties to enhance the performance and functionality of the utility belt. For instance, synthetic fibers such as nylon or polyester can provide high tensile strength and resistance to abrasion, making them ideal for demanding applications. Natural fibers like cotton or hemp may be chosen for their comfort and breathability, offering a softer and more eco-friendly alternative.

For applications requiring additional durability and resistance to environmental factors, materials such as neoprene and/or rubber can be utilized. These materials offer excellent flexibility, waterproof capabilities, and resistance to extreme temperatures and UV rays. Additionally, metal components may be incorporated into the tether portions for added mechanical strength and durability, particularly in high-stress areas.

By selecting the appropriate materials and combining them through various techniques such as stitching, riveting, or adhesive bonding, the tether portions can be fine-tuned to meet the specific needs and preferences of the user. Ultimately, the choice of materials and construction methods will determine the overall performance and longevity of the utility belt.

Figure 3A:
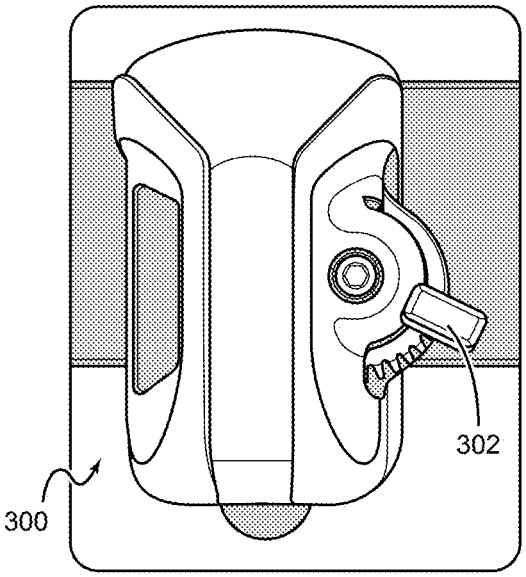
FIG. 3A shows the front of utility coupler.
Figure 3B:
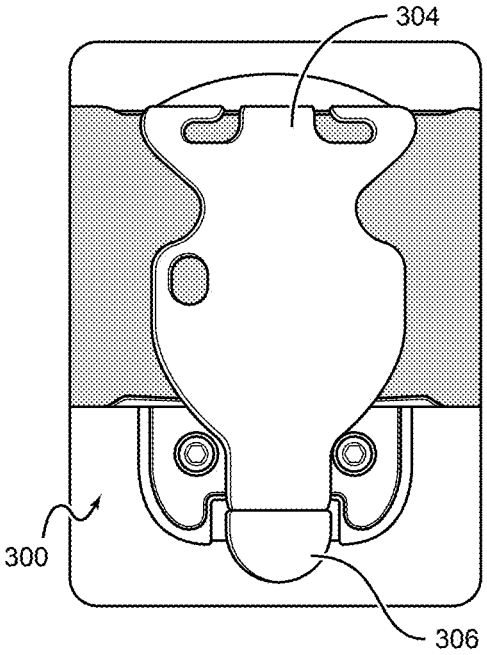
FIG. 3B shows the back of a utility coupler.

FIG. 3A shows a front view of a utility coupler. Utility coupler 300 is configured to couple with a flat portion of a divider section (e.g., flat portion 204 of divider section 200). Utility coupler 300 comprises a rotating locker 302. Rotating locker 302 can lock a tool into utility coupler 300. FIG. 3B shows a back view of utility coupler 300. This view shows latch 304, which features tab 306. Tab 306 is formed as a part of latch 304, and latch 304 snaps into a front portion of utility coupler 300. To unlatch it, a user applies pressure to tab 306, causing the portion of tab 306 that connects to latch 304 to bend, releasing tab 306 from the front portion of utility coupler 300 that it connects to and allowing latch 304 to swing away from the front portion of utility coupler 300. This allows the utility coupler to be removed from a divider section.

Figure 4A:
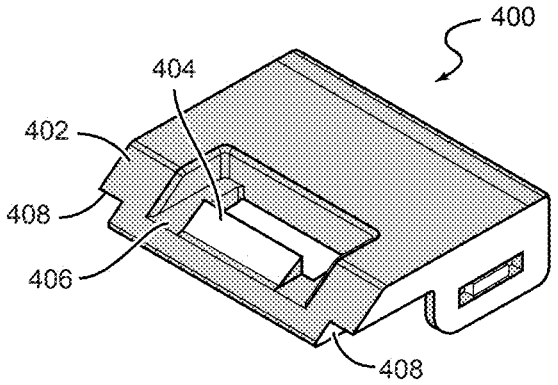
FIG. 4A shows the top of a male magnetic coupler.
Figure 4B:
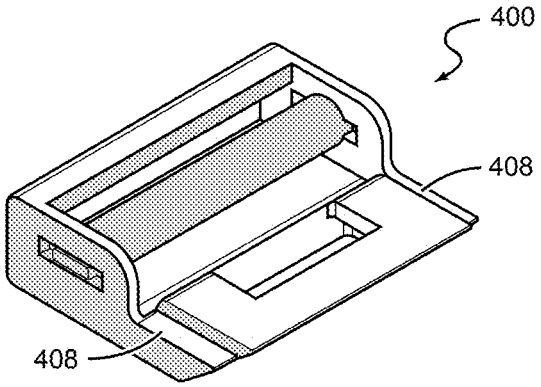
FIG. 4B shows the bottom of the male magnetic coupler.
Figure 5A:
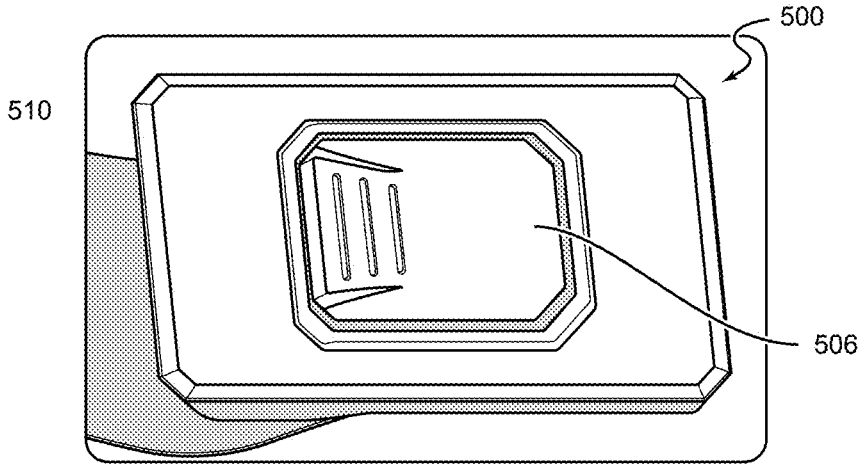
FIG. 5A shows the top of a female magnetic coupler.
Figure 5B:
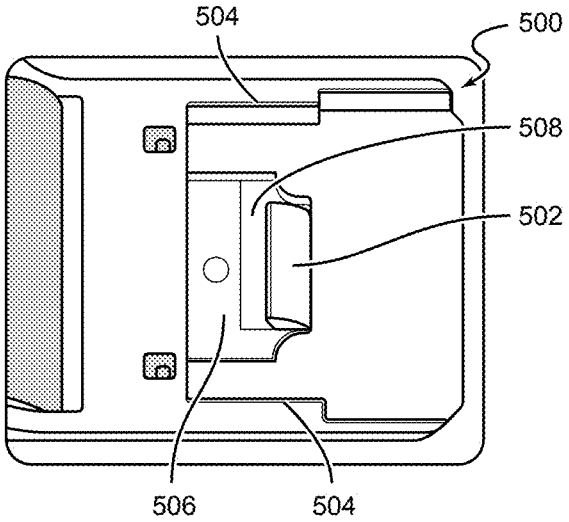
FIG. 5B shows the bottom of a female magnetic coupler.

FIGS. 4A through 5B show magnetic buckles that can be incorporated into embodiments of the inventive subject matter. FIG. 4A shows a top, angled view of a male magnetic buckle 400. Male magnetic buckle 400 features a coupling section having a contact surface 402. Contact surface 402 is disposed on a front portion of male magnetic buckle 400. Contact surface 402 makes it easier to mate male magnetic buckle 400 with female magnetic buckle 500 by guiding male magnetic buckle 400 into female magnetic buckle 500.

Male magnetic buckle 400 features male strike surface 404 that is configured to contact female strike surface 502. Male strike surface 404 is disposed on a bridge section of male magnetic buckler 400, and it extends upward from the bridge surface (as drawn). Bridge section extends lower than surrounding portions of male magnetic buckle 400, creating notches 408. Notches 408 are configured to slot below elongated tabs 504, such that elongated tabs 504 hold male magnetic buckle 400 against female magnetic buckle 500. As male magnetic buckle 400 is inserted into female magnetic buckle 500, male strike surface 404 contacts female strike surface 502. Female strike surface is disposed on release lever 506. Release lever 506 rotates about an axis of rotation between its ends, with the axis of rotation being disposed in a location such that a user pressing against release surface 510 causes release surface 510 to move down and an opposite end of release lever 506 to move up. This action causes female strike surface 502 to move away from male strike surface 404 such that male magnetic buckle 400 can be removed from female magnetic buckle 500.

Female magnetic buckle 500 includes magnet 508 incorporated into release lever 506. Magnet 508 motivates the end of release lever 506 having female strike surface 502 to move toward male magnetic buckle 400 upon its insertion into female magnetic buckle 500. In some embodiments, male magnetic buckle 400 can be the component featuring a magnet without deviating from the inventive subject matter.

Figure 6:
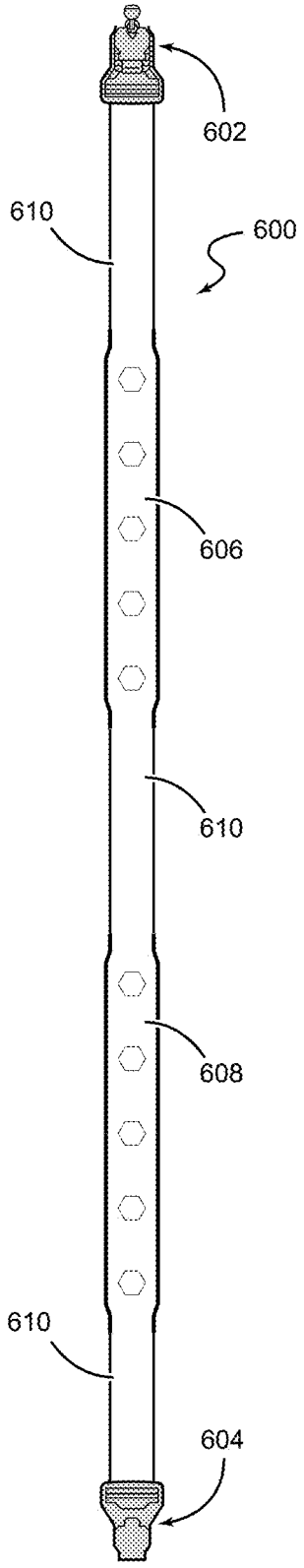
FIG. 6 shows an alternative utility belt embodiment.

FIG. 6 shows an alternative embodiment of the belt shown in FIG. 1. In FIG. 6, belt 600 is formed using at least one piece of material that spans the entire length of the belt. For example, belt 600 can be formed from a piece of rubber that is formed with divider portions 606 that are separated by separation portions 610. In some embodiments, there are no separation portions, and divider portions 606 span the entire length of belt 600.

Belt 600 is still depicted having hexagonal raised portions that are identical to those described in relation to other embodiments shown and described in this application. Male buckle 602 is shown on one end of belt 600, while female buckle 604 is shown on the opposite end. As with other embodiments described in this application, multiple materials can be used to create belt 600, and although belt 600 features at least one piece of material that spans its entire length, additional materials can be used as coatings or coverings to improve its function and feel. For example, a high coefficient of friction material can coat the raised portions to improve their ability to hold tools and other objects that are placed between the raised portions to prevent them from sliding around while belt 600 is worn. All descriptions of materials and coatings included in this application relating to other embodiments apply equally to the embodiment shown in FIG. 6.

Thus, specific systems and methods directed to utility belts have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A utility belt, comprising:

a belt;

a male buckle coupled with a first end of the belt;

a female buckle coupled with a second end of the belt;

a first tether portion of the belt extending from the male buckle;

a first raised divider portion coupled with the first tether portion;

a second tether portion of the belt extending from the first raised divider portion;

a second raised divider portion coupled with the second tether portion;

a third tether portion of the belt extending from the second raised divider portion to the female buckle;

wherein the first raised divider portion comprises first raised dividers, the first raised dividers comprising raised portions that create flatter sections therebetween, the flatter sections configured to accommodate attachments, the raised portions preventing tools from shifting along the belt; and wherein the second raised divider portion comprises second raised dividers, the second raised dividers comprising raised portions that create flatter sections therebetween, the flatter sections configured to accommodate attachments, the raised portions preventing tools from shifting along the belt.

2. The utility belt of claim 1, wherein the first tether portion is coupled to the male buckle by one or more connection techniques such as stitching, riveting, or adhesive bonding.

3. The utility belt of claim 1, wherein the first tether portion, the second tether portion, and the third tether portion each comprise synthetic fibers, and wherein the synthetic fibers comprise nylon or polyester.

4. The utility belt of claim 1, wherein the first tether portion, the second tether portion, and the third tether portion each comprise natural fibers, wherein the natural fibers comprise cotton or hemp.

5. The utility belt of claim 1, wherein the first raised divider portion comprises a coating.

6. The utility belt of claim 5, wherein the coating comprises neoprene or rubber.

7. The utility belt of claim 1, wherein the first tether portion is coupled with the first raised divider portion by one or more connection techniques such as stitching, riveting, or adhesive bonding.

8. The utility belt of claim 1, wherein the male buckle comprises a male strike surface, and the female buckle comprises a female strike surface configured to contact the male strike surface when the male buckle is coupled with the female buckle, and wherein the female buckle further comprises a magnet.

9. A utility belt, comprising:

a belt;

a male buckle coupled with a first end of the belt;

a first tether portion of the belt extending from the male buckle;

a raised divider portion coupled with the first tether portion, wherein the raised divider portion comprises raised dividers, the raised dividers comprising raised portions that create flatter sections therebetween, the flatter sections configured to accommodate attachments, the raised portions preventing tools from shifting along the belt;

a second tether portion of the belt extending from the raised divider portion; and a female buckle coupled with the second tether portion.

10. The utility belt of claim 9, wherein the first tether portion is coupled to the male buckle by one or more connection techniques such as stitching, riveting, or adhesive bonding.

11. The utility belt of claim 9, wherein the first tether portion and the second tether portion each comprise synthetic fibers, and wherein the synthetic fibers comprise nylon or polyester.

12. The utility belt of claim 9, wherein the first tether portion and the second tether portion each comprise natural fibers, wherein the natural fibers comprise cotton or hemp.

13. The utility belt of claim 9, wherein the raised divider portion comprises a coating.

14. The utility belt of claim 13, wherein the coating comprises neoprene or rubber.

15. The utility belt of claim 9, wherein the first tether portion is coupled with the raised divider portion by one or more connection techniques such as stitching, riveting, or adhesive bonding.

16. The utility belt of claim 9, wherein the raised dividers are spaced apart equally.

17. The utility belt of claim 9, wherein the male buckle comprises a male strike surface, and the female buckle comprises a female strike surface configured to contact the male strike surface when the male buckle is coupled with the female buckle, and wherein the female buckle further comprises a magnet.

* * * * *